US006702278B1

(12) United States Patent
Michel

(10) Patent No.: US 6,702,278 B1
(45) Date of Patent: Mar. 9, 2004

(54) PAPER HOLD MECHANISM FOR STACKED PAPER HANDLERS

(75) Inventor: Teodoro Ortiz Michel, Jalisco (MX)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/481,729

(22) Filed: Jan. 11, 2000

(51) Int. Cl.[7] ..... B65H 31/26

(52) U.S. Cl. ..... 271/220; 414/788; 414/907; 271/207; 271/217; 271/219; 358/1.1; 358/1.15

(58) Field of Search ..... 271/280–300, 271/182, 184, 310, 207, 217, 219, 220; 414/788, 907; 358/1.13, 1.5, 1.12

(56) References Cited

U.S. PATENT DOCUMENTS 6,231,045 B1 * 5/2001 Yamada et al. ..... 271/292

* cited by examiner

*Primary Examiner*—David Moore
*Assistant Examiner*—Thierry Pham

(57) ABSTRACT

This invention includes a weighted apparatus for gently holding an existing stack of paper at opposite sides thereof so that a new job may be deposited over the existing stack without degrading the stacking quality of the existing stack. The apparatus may be readily incorporated into many existing paper handling devices which have a paper output tray which is upwardly and downwardly movable in a vertical direction. The apparatus includes a mirror-image pair of paper hold mechanisms, each of which secures a single edge of the existing stack. Each mechanism includes an arm having a longitudinally-oriented slot in a laminar upper end portion thereof and a guide pin anchored to the frame of the paper handling device which passes through the slot. The arm is retained on the pin between a pair of flanged collets. The collets limit movement of the arm within a plane, while the pin constrains the arm to movement along the length of the slot. The arm also incorporates both a cam follower attached to a center portion thereof, and a foot at its lower end, the foot having a stack contacting roller. The mechanism further includes incorporates a cam which is rigidly affixed to the frame of the paper handling device. As the output tray having an existing stack thereon rises upwardly against the roller-equipped feet and is brought to a vertical machine reference level, the arm slides upwardly over the guide pin. As a new output job is deposited on top of the feet, the output tray is lowered in order to maintain the reference level even with the top of the accumulating stack. Near the bottom of the tray's travel, the arms swing outwardly, thereby disengaging the feet from both the existing stack and the newly deposited sheets. The arms are weighted so that each resets and holds both the existing stack and the newly deposited sheets as a single stack as the tray rises.

20 Claims, 13 Drawing Sheets

PAPER HOLD MECHANISM FOR STACKED PAPER HANDLERS

FIELD OF THE INVENTION

This invention relates to paper handling devices, such as paper stackers, staplers, binders, and collators, which are used with printers and copiers and, more particularly, to holders for improving the quality of stacks of paper generated by such devices.

BACKGROUND OF THE INVENTION

Dedicated printers, copiers and facsimile machines commonly employ paper handling devices which perform tasks such as stacking, stapling, binding and collating. Dual-purpose machines which incorporate both printing and copying functions are becoming increasingly common in the office environment. For home offices, multi-function machines which incorporate not only printing and copying functions, but facsimile send and receive functions as well, have become very popular.

Designers of paper handling devices coupled to printers and copiers must take into consideration the quality of paper stacks generated during an output session. At the very least, high quality stacks output bins are aesthetically pleasing. If the paper handling device is engaged in stapling and binding operations, stack quality cannot be ignored. Unevenly stacked paper sheets will neither bind nor staple well. In addition, it is far simpler to provide additional handling operations for neatly stacked sheets than for those which are stacked unevenly. For paper handling devices which generate an intermediate stack that is fed to another paper handling device, good stack quality eliminates the need to subject the stack to an extra registration process.

Poor stack quality may be caused by several factors. Some of those factors are:

(a) motion of a sheet of paper when a new job arrives on top of an existing stack of already printed sheets;

(b) misalignment of sheets in an existing stack brought about by vertical movement of an output tray as it returns to its home position;

(c) non planarity of individual sheets;

(d) non-transnational movement of individual sheets as they are ejected into the output tray;

(e) improper vertical positioning of the output tray as it begins to receive a new job;

(f) non-uniform size of print media sheets; and (g) strain induced in sheets overlying one or more stacks of stapled sheets.

In studies performed at the printer development labs of the Hewlett-Packard Co., it has been ascertained that factor (a) is one of the most common causes of poor stack quality. What is needed is a mechanism for holding an existing stack of printed pages while the output tray repositions itself to receive a new job and while the new job is being output to the tray. The holding mechanism will prevent relative motion from arriving sheets pertaining to the new job from being transferred to the sheets of an existing stack.

SUMMARY OF THE INVENTION

This invention includes a weighted apparatus for gently holding an existing stack of paper at opposite sides thereof so that a new job may be deposited over the existing stack without degrading the stacking quality of the existing stack.

The apparatus may be readily incorporated into many existing paper handling devices which have a paper output tray which is upwardly and downwardly movable in a vertical direction. The apparatus includes a mirror-image pair of paper hold mechanisms, each of which secures a single edge of the existing stack. Each mechanism includes an arm having a longitudinally-oriented slot in a laminar upper end portion thereof and a guide pin anchored to the frame of the paper handling device which passes through the slot. The arm is retained on the pin between a pair of flanged collets. The pin limits movement, which together, limit movement of the arm in a plane and. The collars limit movement of the arm within a plane, while the pin constrains the arm to movement along the length of the slot. The arm also incorporates both a cam follower attached to a center portion thereof, and a foot having a stack contacting roller at its lower end. The mechanism further includes incorporates a cam which is rigidly affixed to the frame of the paper handling device. As the output tray having an existing stack thereon rises upwardly against the roller-equipped feet and is brought to a vertical machine reference level, the arm slides upwardly over the guide pin. As a new output job is deposited on top of the feet, the output tray is lowered in order to maintain the reference level even with the top of the accumulating stack. Near the bottom of the tray's travel, the arms swing outwardly, thereby disengaging the feet from both the existing stack and the newly deposited sheets. The arms are weighted so that each resets and holds both the existing stack and the newly deposited sheets as a single stack as the tray rises.

Two embodiments of cam and cam follower are disclosed. The first embodiment utilizes a cam having opposing faces first and second faces, each of which incorporates a path. The free end of the cam follower arm is positioned between both faces. A collar, which is rigidly affixed to the free end, encloses a follower pin that is laterally slidable between the two faces, so that the pin can engage a path on either face. The path on each face has a raised portion so that the follower pin can be transferred between the paths on the opposing faces. The second embodiment utilizes a cam having a single face and a topographic path. The lower portion of the upward vertical path is raised above the downward and outward curving path. A follower pin retainer is rigidly affixed to the free end of the cam follower arm. The retainer holds a spring-loaded laterally-slidable follower pin. Spring loading of the follower pin allows the pin to follow the topographic path. On the downward and outward curving path taken by the holder arm, the follower pin engages a low-level groove. However, on the lower portion of the upward vertical path, the path rises to a higher level. Thus, at the intersection of the rising vertical path and the downward and outward curing path, the follower pin abruptly drops off a high level ledge to the lower level. The follower pin continues to engage the lower level groove during the remainder of the upward travel. Other cam/cam follower systems that use separate downward and upward paths are also possible.

DETAILED DESCRIPTION OF THE INVENTION

This invention includes a weighted apparatus for gently holding an existing stack of paper at opposite sides thereof so that a new job may be deposited over the existing stack without degrading the stacking quality of the existing stack. The apparatus may be readily incorporated into many existing paper handling devices which have a paper output tray which is upwardly and downwardly movable in a vertical direction.

Figure 1:
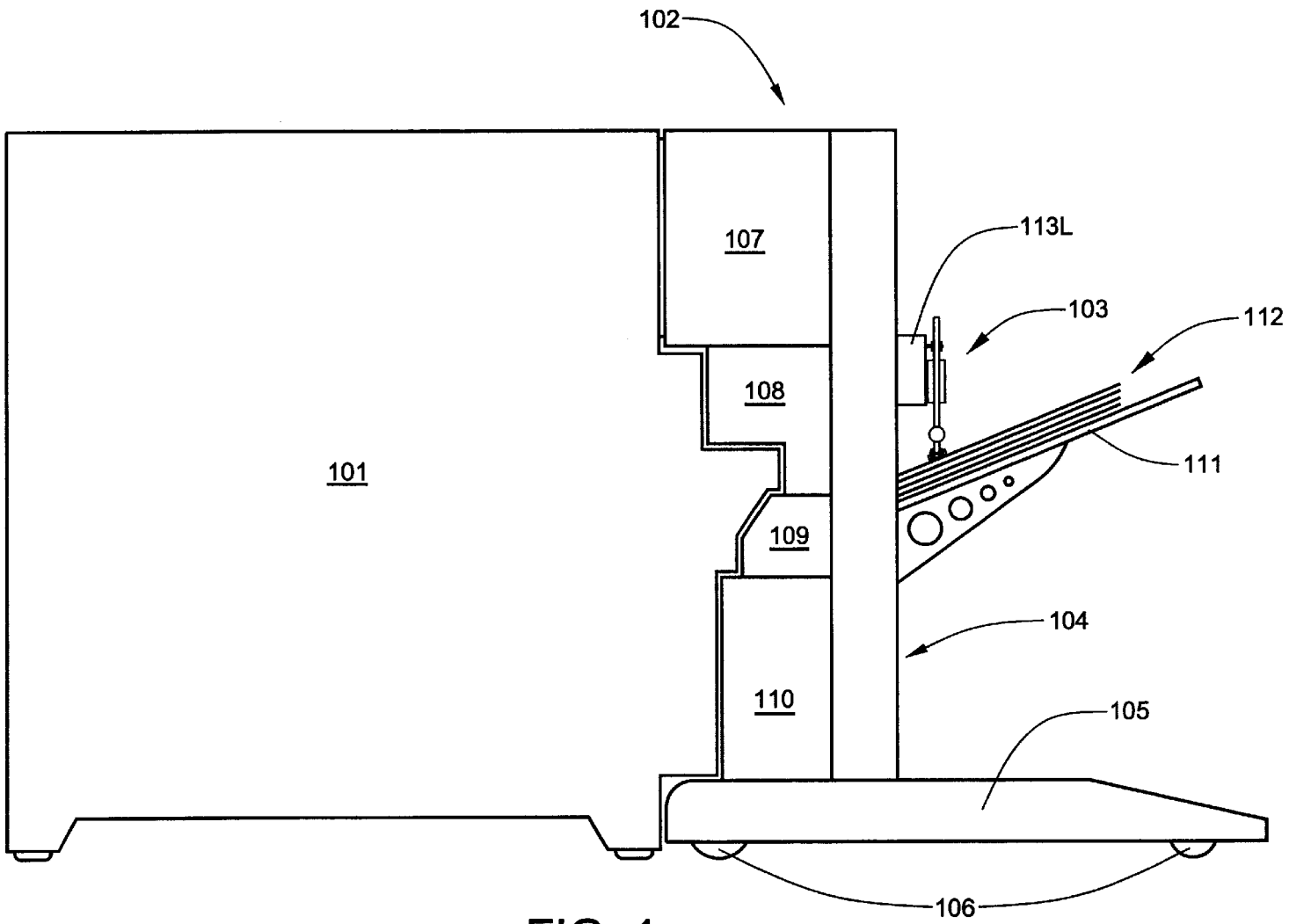
FIG. 1 is a front elevational view of a representative printing device coupled to a paper handling device incorporating the invention, the paper handling device being shown in a left-side elevational view.

FIG. 1 depicts a representative printing device 101 which is connected to a paper handling device 102 which incorporates the invention 103, which is the stack holding apparatus. The paper handling device includes a frame 104 and a base 105 having casters 106, which permit the paper handling device 102 to be rolled away from the printing device 101 to facilitate servicing of both devices. The paper handling device 102 also includes a paper receiving module 107, a paper eject module 108, an output tray position sensing module 109, and a tray positioning module 110 which raises and lowers an output tray 111, in response to stack position sensing signals received from the sensing module 107, as sheets are ejected by the paper eject module 108 into the tray 111 to form an output stack 112. The invention, or stack holding apparatus, 103 is affixed to the paper handling device 102 via a pair of stand-off structures 113L and 113R (generally 113), one of which (113L) is seen in a side profile in this view. Each stand-off structure 113 is rigidly affixed to an upper sheet metal wall (not shown in this view) of the paper handling device 102.

Figure 2:
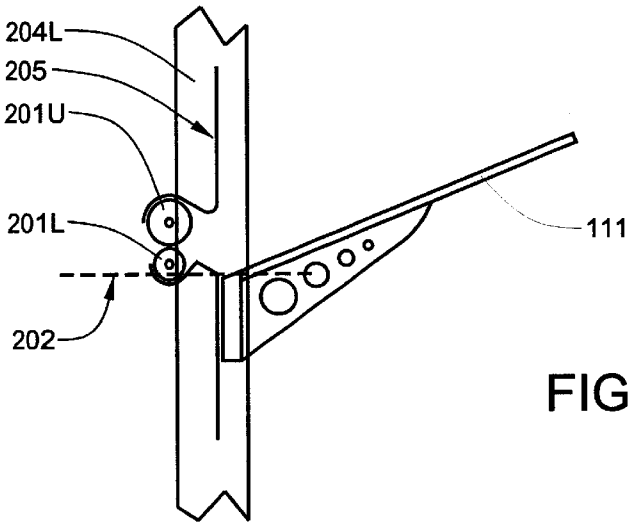
FIG. 2 is a see-through side elevational view of a portion of the paper handling device, showing the paper eject rollers and an empty output tray positioned at the reference level for the receipt of a new output job.
Figure 3:
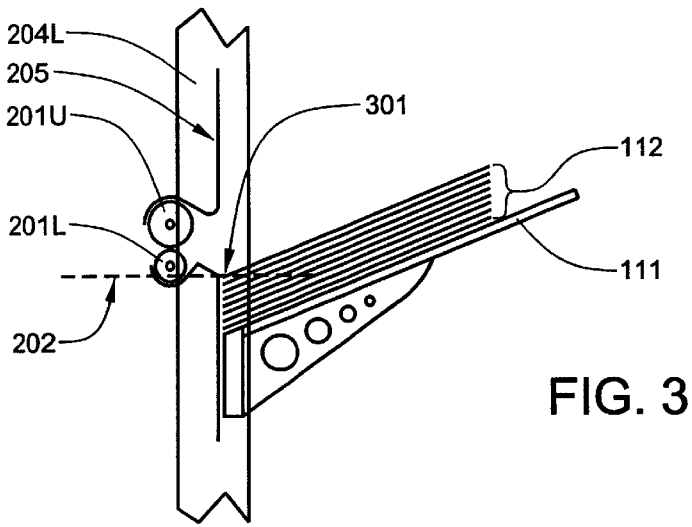
FIG. 3 is a see-through side elevational view of a portion of the paper handling device, showing the paper eject rollers and a partially-full output tray with the top of the stack positioned at the reference level for the receipt of additional output.

Referring now to FIG. 2, this view of a portion of the paper handling device shows the upper and lower paper eject rollers (201U and 201L, respectively) and an empty output tray 111 awaiting the receipt of a new print/copy job, being positioned at a reference level 202 on the frame 104 of the paper handling device 102. The left frame rail 204L of the paper handling device 102 is visible in this view, as is the sheet metal upper wall 205, which provides a mounting surface for the stand-off structures 113L and 113R. FIG. 3 shows the same portion of the paper handling device, but with the output tray 111 partially-full. It will be noted that as additional sheets are ejected onto the tray 111 by eject rollers 201U/201L, the tray 111 is lowered so as to maintain the upper rear edge 301 of the output stack 112 positioned at the reference level 202. By maintaining the upper rear edge 301 of the stack 112 at the reference level 202, optimum stacking of sheets is enabled. As additional sheets are fed from the eject rollers 201U/201L to the output tray 111, the tray is lowered still farther in order to maintain the upper rear edge 301 of the stack 112 at the reference level 202.

Figure 4:
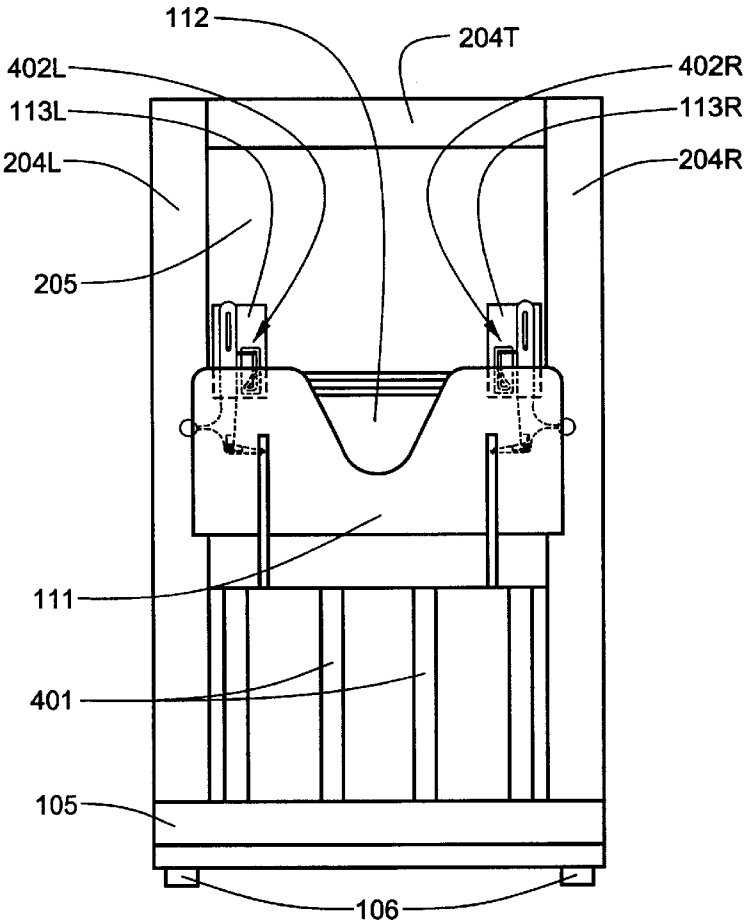
FIG. 4 is a front elevational of the paper handling device shown in FIG. 1.

Referring now to FIG. 4, more details of the invention 103 and of the paper handling device 102 are visible. The frame of the device 102 includes the base 105, the left frame rail 204L, a right frame rail 204R, and a top cross member 204T. The output tray 111 is raised and lowered by a jack 401 that is controlled by the tray positioning module 110 (see FIG. 1). An output 112 stack is shown resting on the tray 111. The invention 103 is an apparatus which comprises a mirror-image pair of paper hold mechanisms 402L and 402R (generally 402), each of which secures a single edge of an existing output stack 112.

Figure 5:
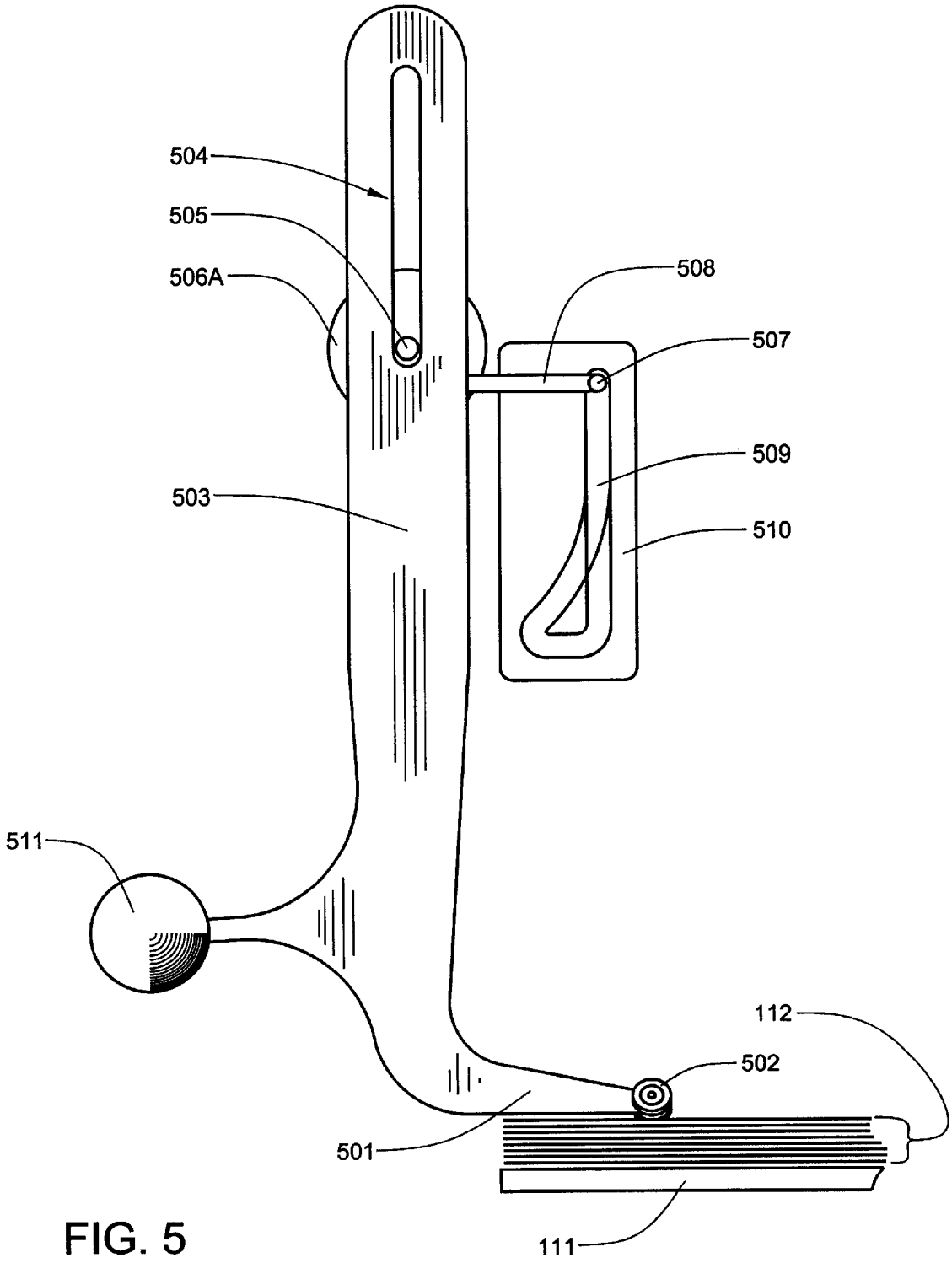
FIG. 5 is a front elevational view of the left-side paper hold mechanism, with the arm positioned at the point of maximum upward travel, the right-side mechanism being a mirror image thereof.

Referring now to FIG. 5, an upper edge of an existing output stack 112 is secured by one of the paper hold mechanisms (in this case the left mechanism 402L). As the description and function of the left mechanism is identical to that of the right mechanism 402R, except that its operation and appearance is a mirror of that of the left mechanism, the left and right designators will be dropped for the description of the mechanism. Furthermore, when one mechanism 402 is referred to and described, the description is applicable to both mechanisms. The mechanism 402 includes a foot 501. The free end of foot 501 is equipped with a roller 502 which rests on the stack 112, thereby securing it. The foot 501 is an extension of the lower end of an arm 503. The arm 503 has a longitudinally-oriented slot 504 near the upper end thereof which slides over a guide pin 505 that is anchored via a stand-off structure 113 to the sheet metal upper wall 205 of the paper handling device 102. Flanged collets 506A and 506B (only 506A is shown in this view) mounted on the pin 505 secure the arm 503 so that its movement substantially constrained within a plane. The arm 503 also incorporates a cam follower 507 that is affixed to a stalk 508 that, in turn, is rigidly affixed to the arm 503. The cam follower 507 follows the grooved path 509 of a cam 510 that is also rigidly affixed to the stand-off structure 113. It will be noted that the arm further incorporates a counterbalance weight 511, which more than counterbalances the foot 501 and roller 502. The counterbalance weight 511 is important for the successful functioning of the retract movement shown in FIG. 10.

Still referring to FIG. 5, the cam follower 507 is designed and the path 509 of the cam 510 is shaped such that as the output tray 111 pushes upwardly against the foot 501, the arm 503-maintaining an approximately vertical orientation—slides upwardly over the guide pin 505. When the arm 503 has reached the highest point of upward travel as depicted in this view, the top of the existing stack 112 is positioned near the reference level 202, and is ready to receive a new output job. It should be mentioned that with the invention 103 installed on the paper handling device 102, the height of the foot 501 should be taken into account in order to calibrate the reference level 202. Thus, with the invention 103 installed, the tray will be portioned slightly lower when at the reference level 202 than it would be if the invention 103 is not installed thereon.

Figure 6:
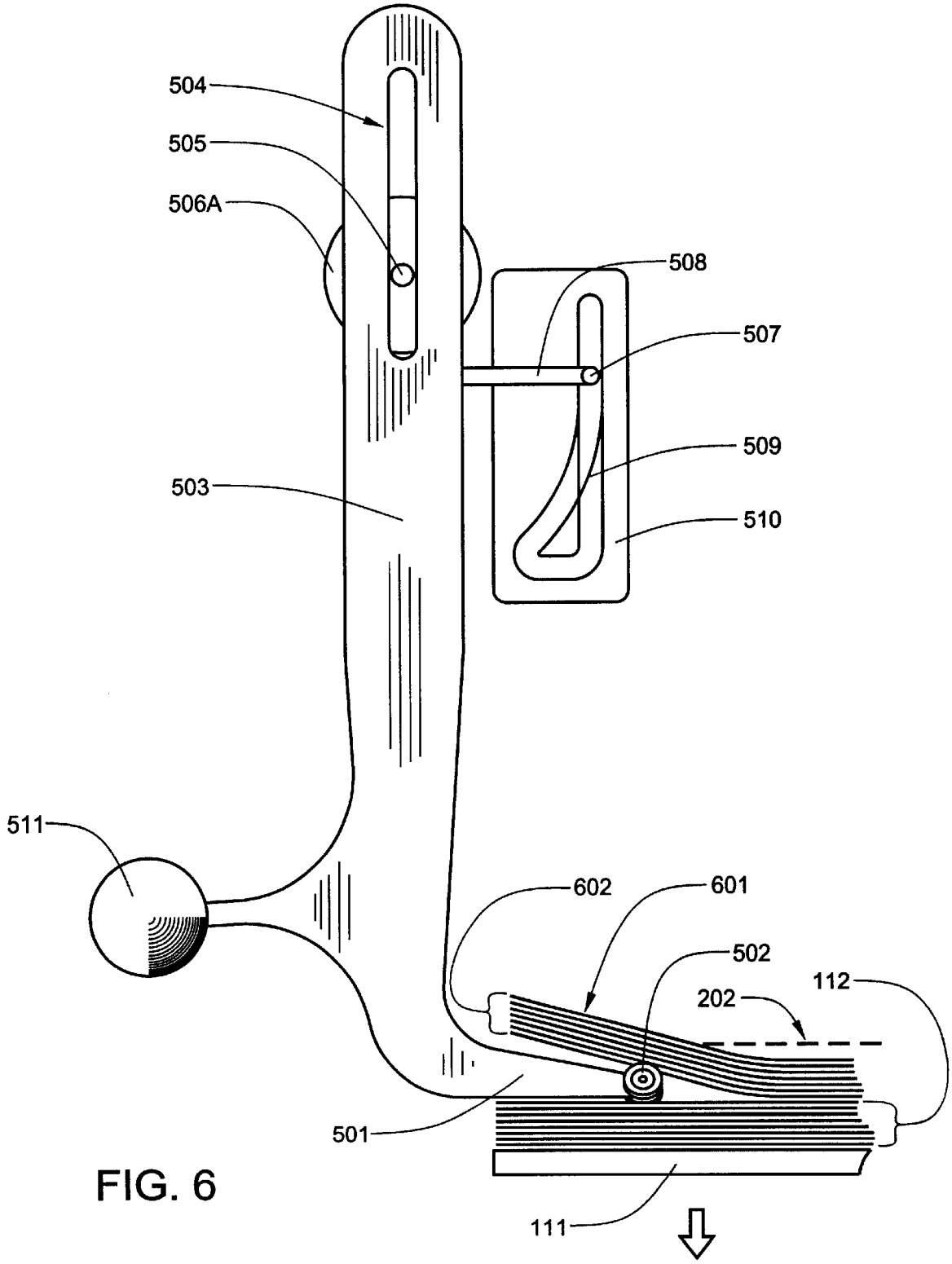
FIG. 6 is a front elevational view of the left-side paper hold mechanism of FIG. 5, showing the arm at a first point of downward travel.

Referring now to FIG. 6, gravitational force has caused the arm 503 to fall as the output tray 202 is lowered by jack 401 in response to the output of a certain quantity of newly printed sheets 601 on top of the existing stack 112. The lowering of the tray 111 has maintained the top of the new stack 602 at the reference level 202. Working together, the guide pin 505, the cam follower 507, and the cam 510 direct the downward movement of the arm 503.

Figure 7:
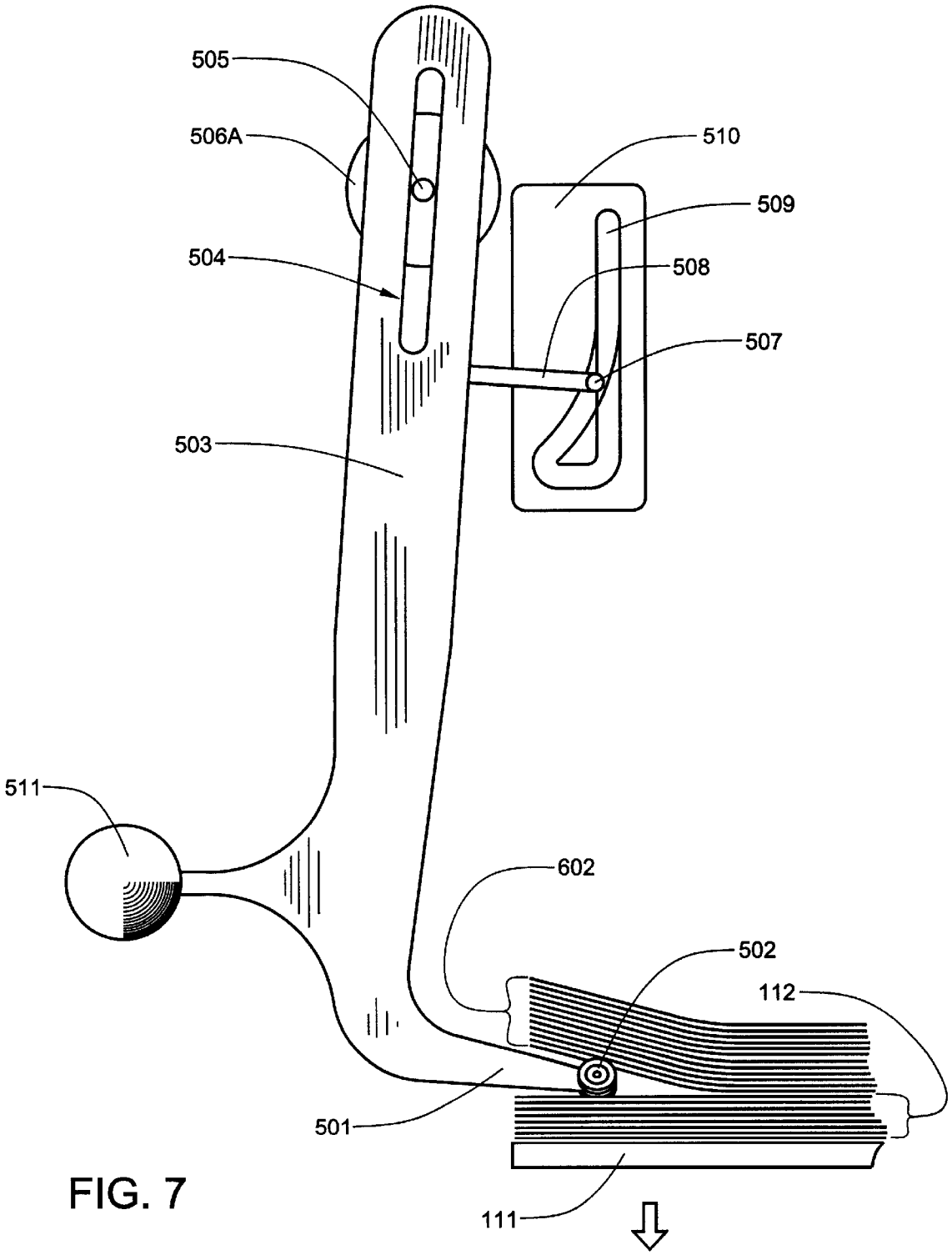
FIG. 7 is a front elevational view of the left-side paper hold mechanism of FIG. 5, showing the arm at a second point of downward travel.

Referring now to FIG. 7, the arm 503 has fallen further in response to a lowering of the output tray 111 as additional sheets 701 have been deposited thereon. It will be noted that the arm 503 is beginning to move to the left in response to the arcuate portion 702 of path 509 on cam 510.

Figure 8:
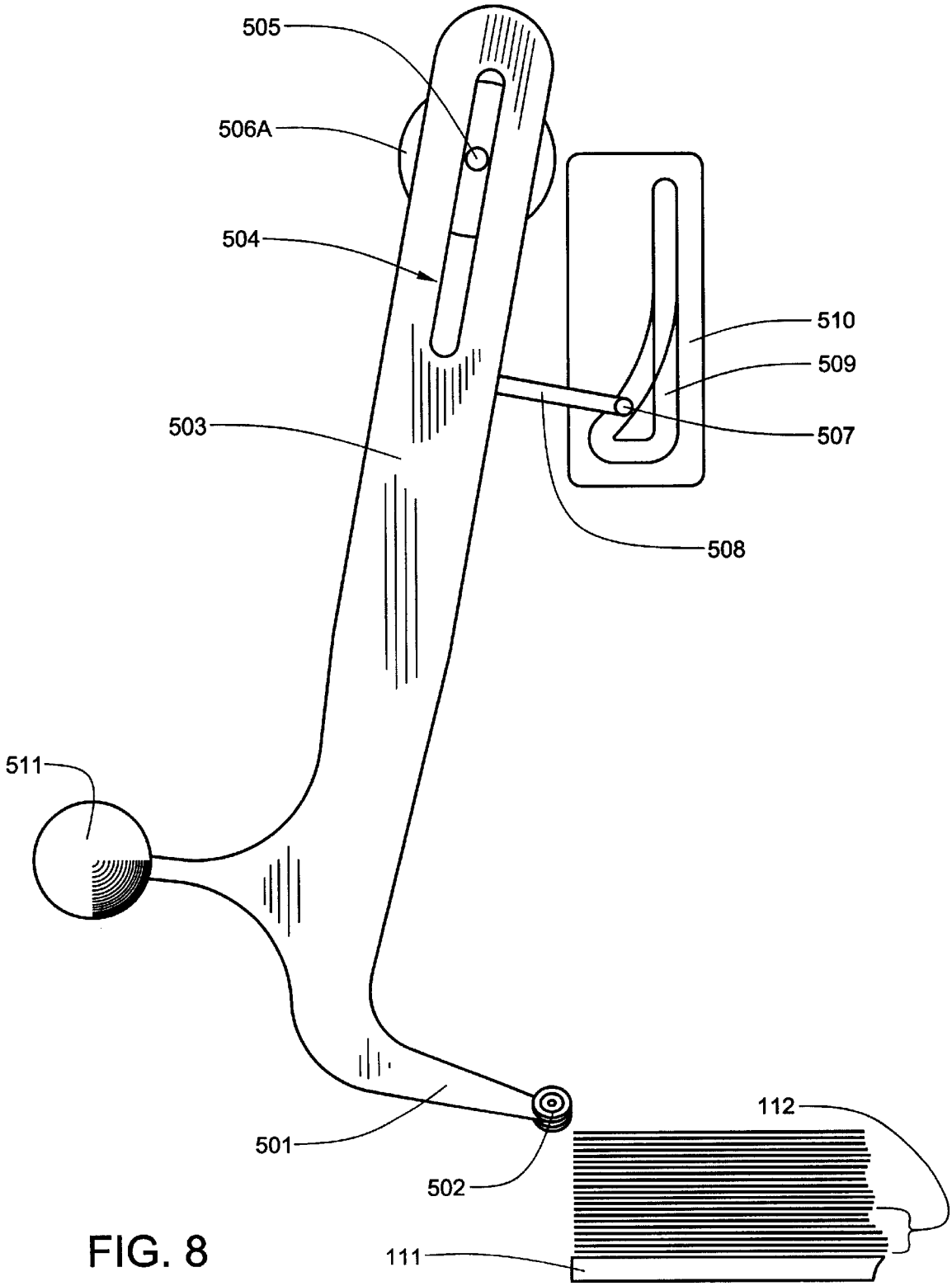
FIG. 8 is a front elevational view of the left-side paper hold mechanism of FIG. 5, showing the arm at a third point of downward travel.

Referring now to FIG. 8, it will be noted that the arm 503 fallen still further downward, and the roller 502 has just disengaged the stack as the path 509 of cam 510 displaces the arm 503 laterally to the left. The arm 503R of the right paper hold mechanism 401R (not shown) is, of course, mirroring the action of the right mechanism 401L, with disengagement of the roller 502R from the stack 112 being to the right rather than the left.

Figure 9:
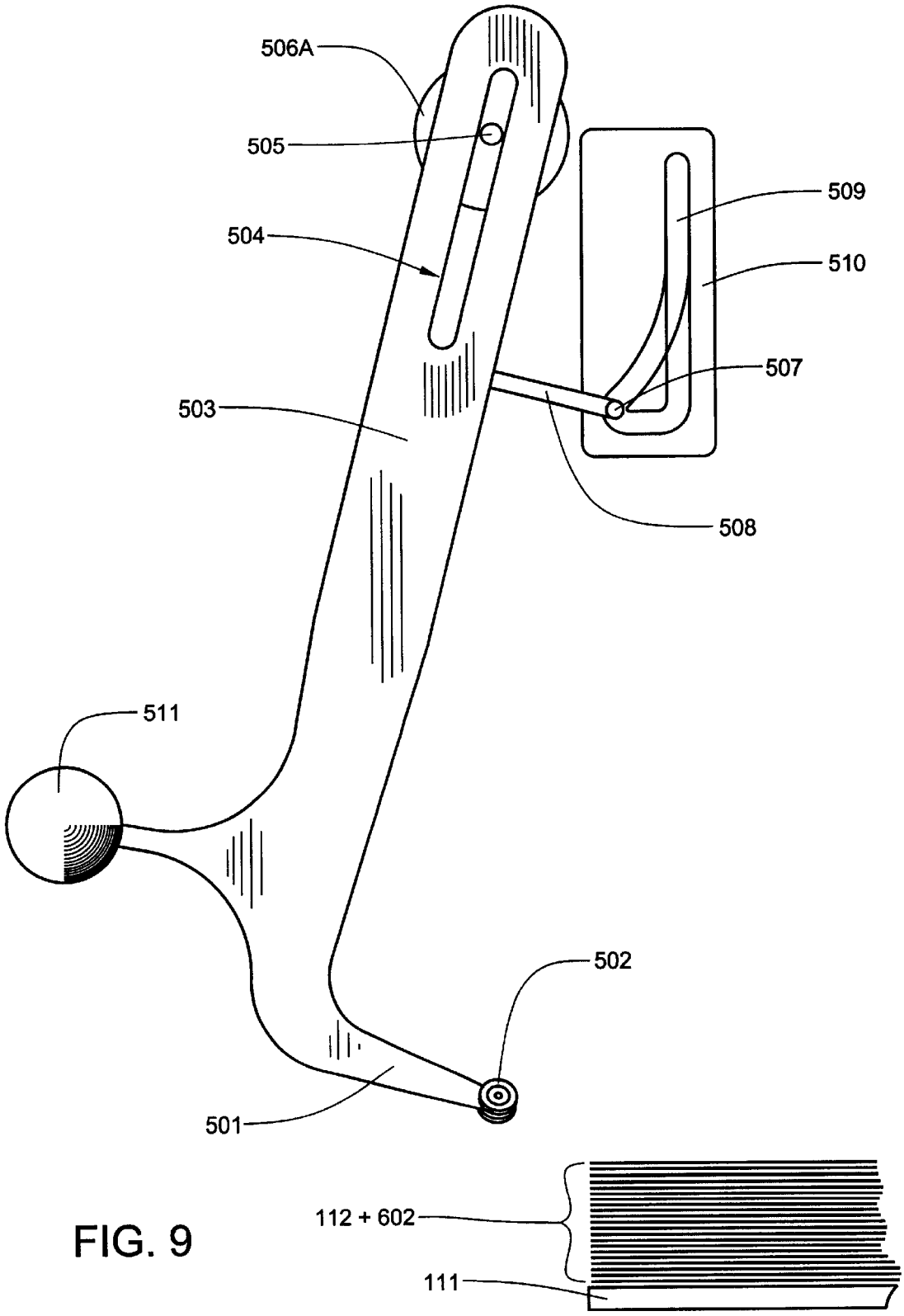
FIG. 9 is a front elevational view of the left-side paper hold mechanism of FIG. 5, shown with the foot at the point of maximum lateral displacement.

Referring now to FIG. 9, the arm 503 has reached it point of maximum displacement from the vertical, thereby completely disengaging the roller 502 from its position between the old stack 112 and the new stack 602.

Figure 10:
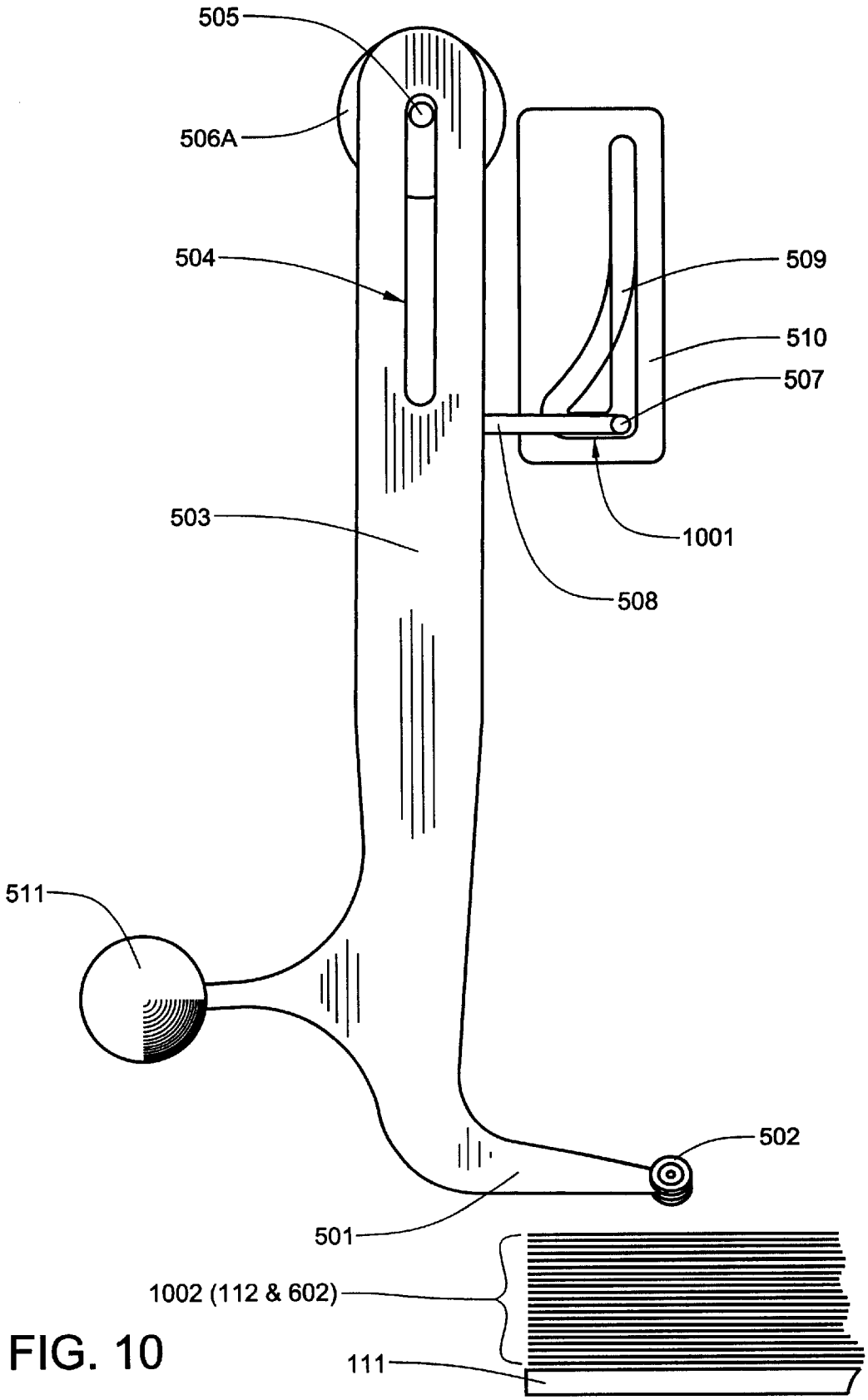
FIG. 10 is front elevational view of the left-side paper hold mechanism of FIG. 5, with the arm positioned at the point of maximum downward travel, and ready to be lifted vertically upward by the output tray.

Referring now to FIG. 10, the arm 503 fallen to its lowest point of downward travel, thereby allowing the cam follower 507 to engage a retract portion 1001 of path 509 on cam 510. The output tray 111 is now ready to be lifted vertically, thereby raising the arm 503 with it as the roller 502 makes contact with the composite stack 1002, which includes sheets from both the old and new stacks (112 and 602, respectively).

Figure 11:
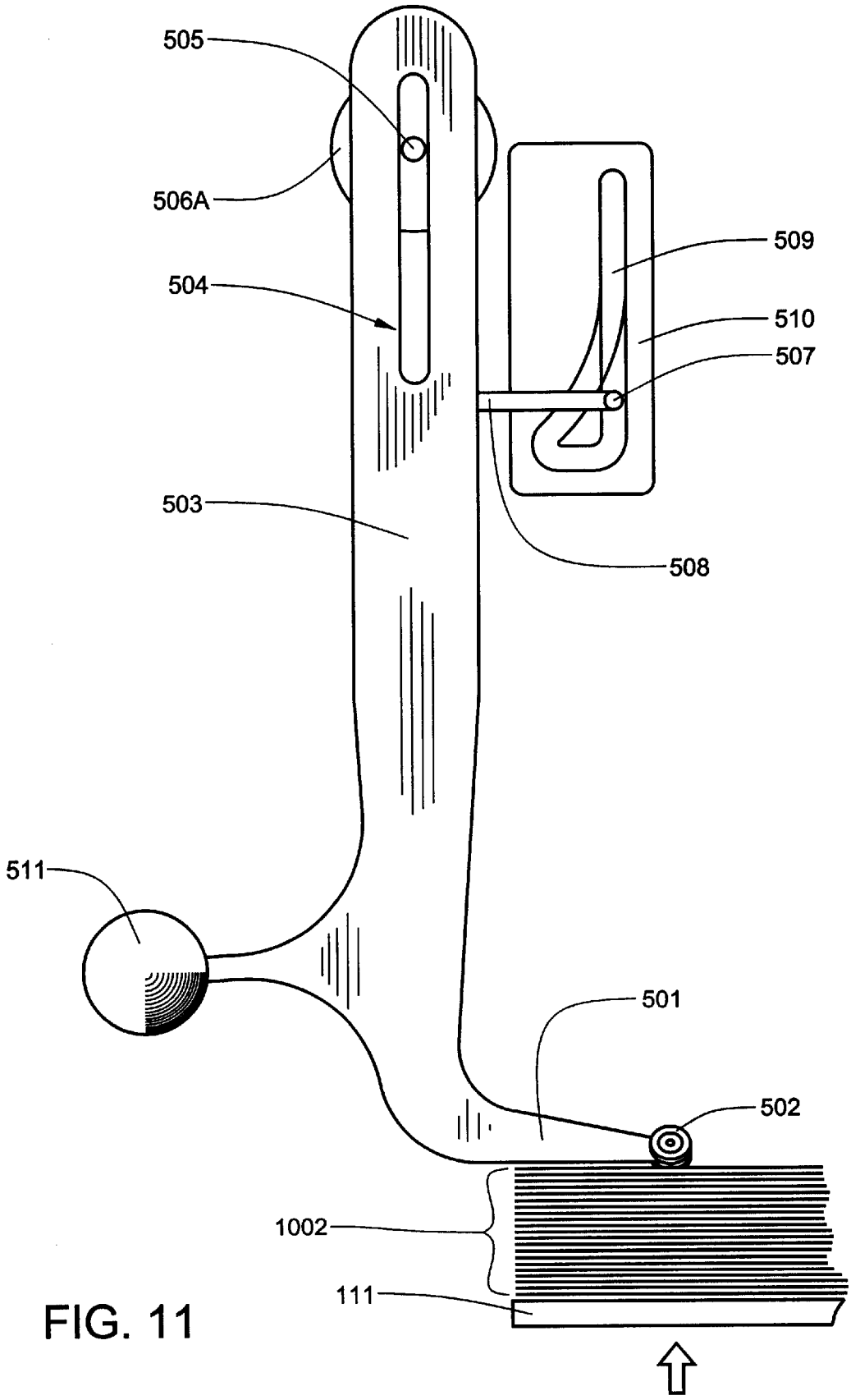
FIG. 11 is a front elevational view of the left-side paper hold mechanism of FIG. 5, showing the arm at a first point of upward vertical travel.
Figure 12:
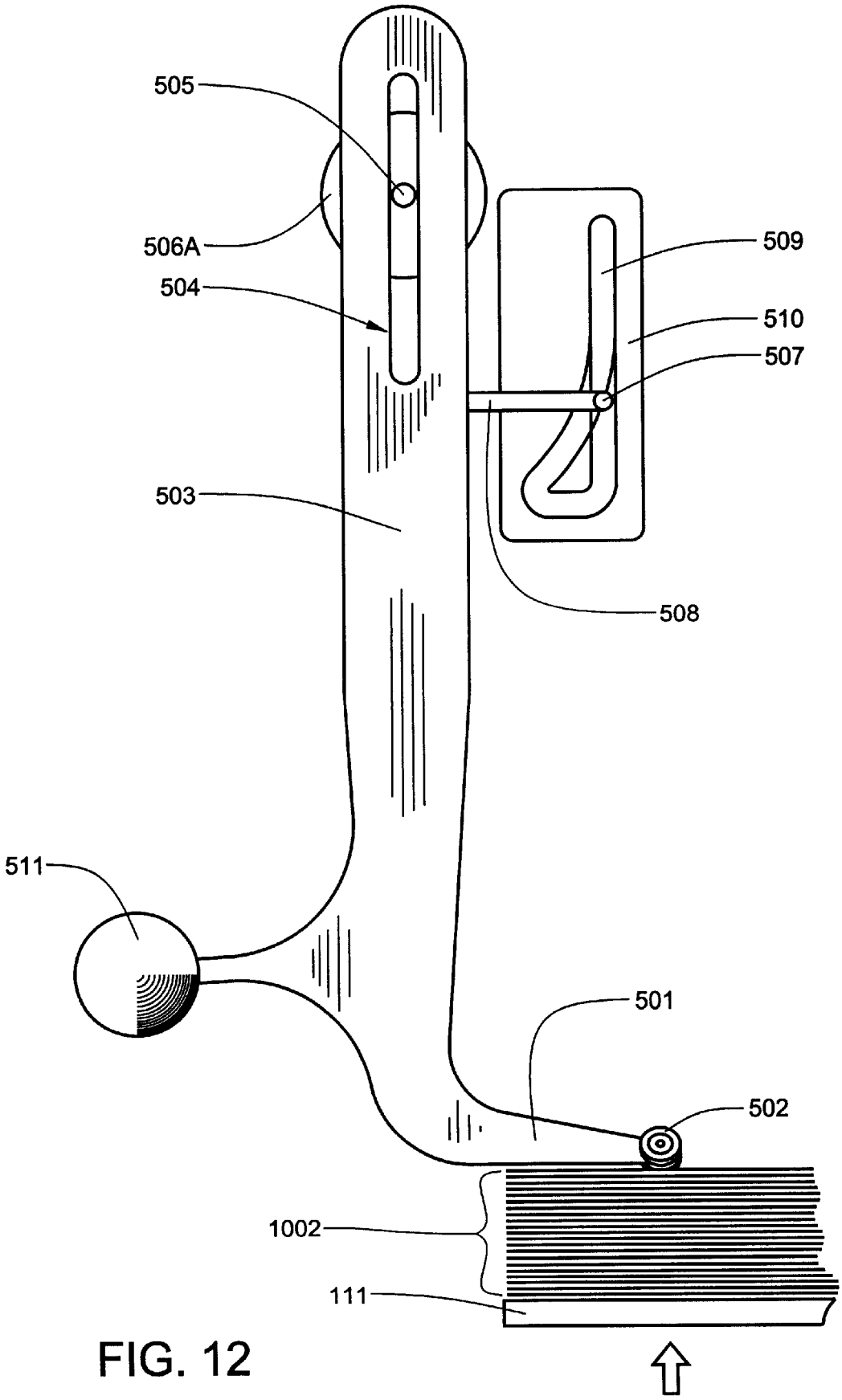
FIG. 12 is a front elevational view of the left-side paper hold mechanism of FIG. 5, showing the arm at a second point of upward vertical travel.
Figure 13:
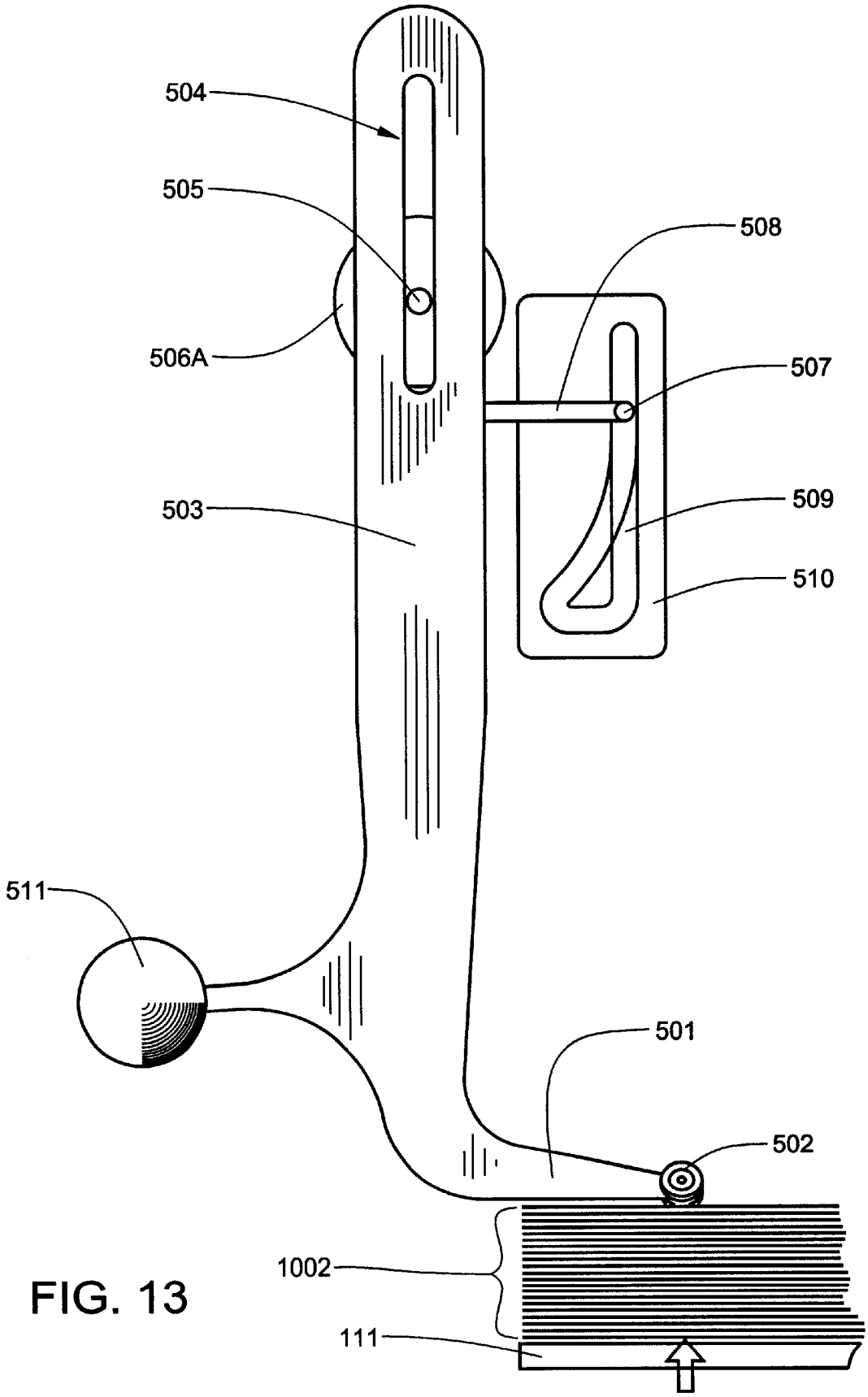
FIG. 13 showing the arm at a third point of upward vertical travel.

FIGS. 11, 12 and 13 show various positions of the arm 503 on its upward path, which will end when the top of the composite stack 1002 reaches the reference level 202. The cycle then begins anew.

Figure 14:
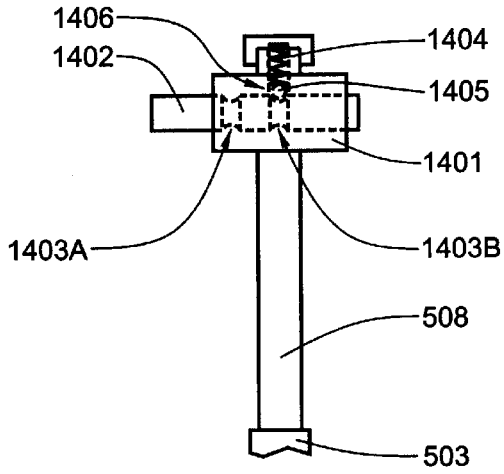
FIG. 14 is a top planar view of a first embodiment cam follower having a follower pin slidable between first and second detent positions.

Referring now to FIG. 14, a first embodiment cam follower 507A includes a collar 1401 that is rigidly affixed to the stalk 508 which, in turn, is rigidly affixed to the arm 503. A follower pin 1402 having two circumferential detent grooves 1403A and 1403B (generally 1403) is slidably mounted within the collar 1401. A detent spring 1404 and detent ball 1405 are mounted within a cylindrical cavity 1406 that is perpendicular to and centrally located along the axis of the collar 1401. The two grooves 1403A and 1403B represent the outer limits of travel of follower pin 1402 during the operation of the paper holding apparatus 102. When the detent ball 1405 engages one of the detent grooves 1403A or 1403B, vibration, alone, is unable to move the follower pin 1402. However, ramps (hereinafter described) incorporated within the grooved path 509 on the first embodiment cam 510A are able to shift the follower pin 1402 from one detent position to the other.

Figure 15:
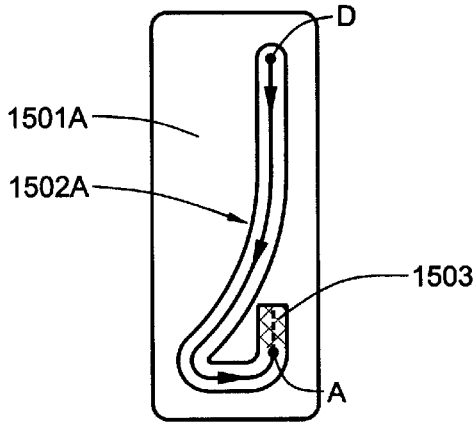
FIG. 15 is a front elevational view of the first face of a first embodiment cam.
Figure 16:
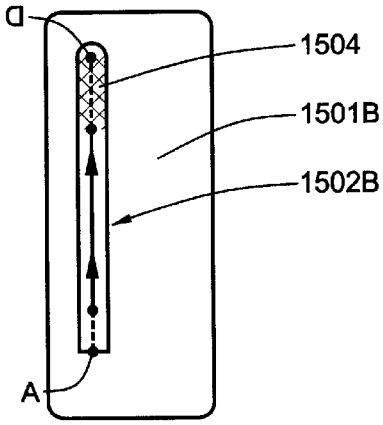
FIG. 16 is a front elevational view of the second face of a first embodiment cam.

Referring now to FIGS. 15 and 16, a first embodiment cam 510A has been disassembled to show a first cam face 1501A, which is spaced apart from, parallel to and opposed to a second cam face 1501B. For the first embodiment cam 510, a first path portion 1502A of the grooved path 509 is contained on the first cam face 1501A, while a second remaining portion 1502B is contained on the second cam face 1501B. The first path portion 1502A guides the first embodiment cam follower 507A from the beginning of the downward stroke, through the point of maximum displacement (shown in FIG. 8), and to the retract position (shown in FIG. 9). After retraction of the arm 503 is accomplished, the first path portion 1502A incorporates a first ramp 1503 which shifts the slidable follower pin 1402 of cam follower 507A to the second path portion 1502B contained in the second cam face 1501B. The second groove 1502B directs the first embodiment cam follower 507A from the beginning of the upward stroke to the top of the upward stroke. At the top of the upward stroke, the second path portion 1502B incorporates a second ramp 1504, which shifts the follower pin 1402 back to the first path portion 1502A in the first cam face 1501A.

Figure 17:
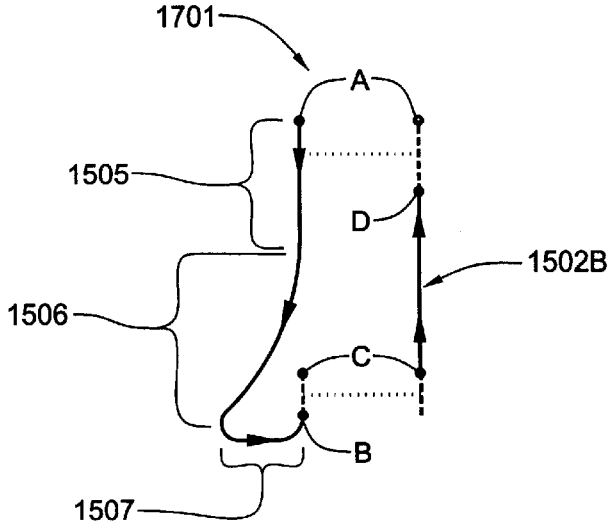
FIG. 17 is diagram which shows the entire path of the cam follower, together with transition regions where the cam follower shifts from one face of the cam to the other face.

Referring now to FIG. 17, the entire path of the first embodiment cam, comprising opposing cam faces 1501A and 1501B, is shown as a single diagram 1701, together with the ramped transition regions 1503 and 1504 where the follower pin 1402 shifts from one face of the cam to the other face. The second path portion 1502B is vertically upward, while the first path portion 1502A includes a upper downward vertical portion 1505, a lower downward portion 1506 that arcs away from the center of the stack 112, and a horizontal return portion 1507 which connects the lowermost points of the downward and upward portions. The first path portion 1502A and the second path portion 1502B are connected by dotted lines at points A and C so that they may be shown in a non-overlapping format. From point A to point B, the cam follower follows the first path 1502A on first cam face 1501A. Between point B and point C, the first ramp 1503 shifts the follower pin 1402 from the first detent position (defined by circumferential groove 1403A) to the second detent position (defined by circumferential groove 1403B), thereby transferring control of the follower pin 1402 to the second path 1502B on the second cam face 1501B. From point C to point D, the cam follower follows the second path 1502B on the second cam face 1501B. Between point D and point A, the second ramp 1504 shifts the follower pin 1402 from the second detent position back to the first detent position, thereby transferring control of the follower pin 1402 to the first path 1502A on the first cam face 1501A.

Figure 18:
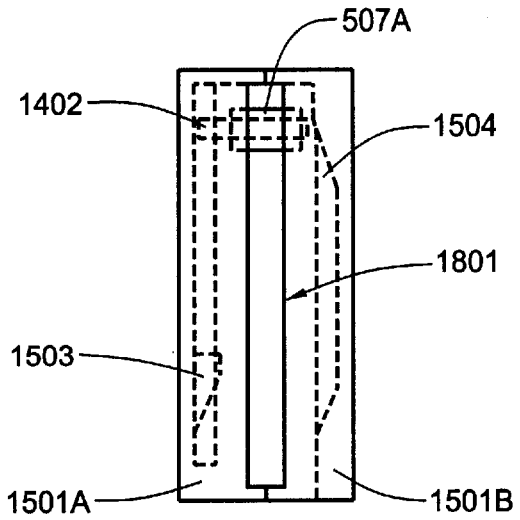
FIG. 18 is a side elevational view of the first embodiment cam, showing both faces in profile view, each of which provides a portion of the cam follower path.

Referring now to FIG. 18, both faces are shown coupled together in a side view. The first ramp 1503 is visible on the first cam face 1501A, while the second ramp 1504 is visible on the second cam face 1501B. When the two halves of the cam 412B are assembled, a follower guide slot 1801 is formed which guides the stalk 410 to which the cam follower 409A is attached.

Figure 19:
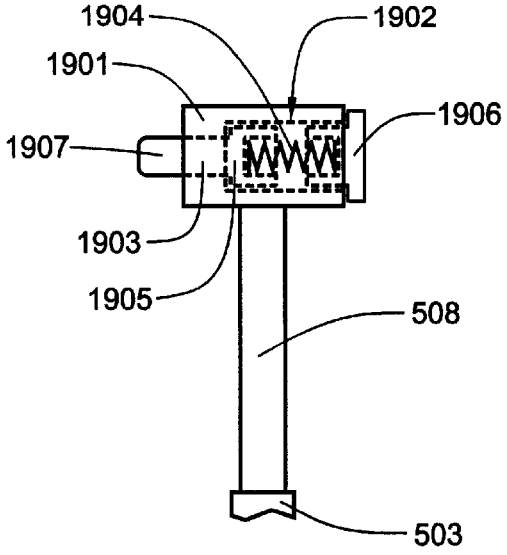
FIG. 19 is a top planar view of a second embodiment cam follower having a spring-loaded slidable follower pin trapped within a pin housing.

Referring now to FIG. 19, a second embodiment cam follower 507B includes a pin carrier 1901 that is rigidly affixed to the stalk 508 which, in turn, is rigidly affixed to the arm 503. The pin carrier 1901 has a cylindrical cavity 1902 in which a collet-head follower pin 1903 and a spring 1904 biased against the collet head 1905 of follower pin 1903 are slidably trapped by an end cap 1906. A cylindrical end 1907 of the pin 1903 extends outside the pin carrier 1901 and rides on the single face of the second embodiment cam 510B, which will be described hereinafter. The resiliently biased collet-head follower pin 1903 allows the second embodiment cam follower 507B to follow a path or groove on the second embodiment cam 510B that is of non-uniform depth.

Figure 20:
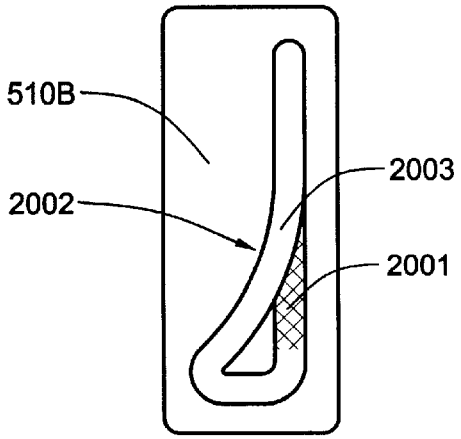
FIG. 20 is a front elevational view of the single face of the second embodiment cam which has the entire follower path thereon.

Referring now to FIG. 20, a second embodiment cam 510B is shown. The upward and downward grooved paths are identical in shape to those provided by the first embodiment cam 510A. Rather than using two opposed faces as does the first embodiment cam 510A, the second embodiment cam 510B employs a single ramp 2001 within the grooved path 2002, which acts as a one-way switch or deflector on the downward arcuate stroke of cam follower 507B. Because the cam follower 507B is gravitationally biased against the outside wall of grooved path 2002, the precipitous transition from the high point of the ramp 2001 to the lower portion 2003 of grooved path 2002 is smooth. The second embodiment cam 510B may also incorporate a follower guide slot such as the guide slot 1801 of the first embodiment cam 510A.

Figure 21:
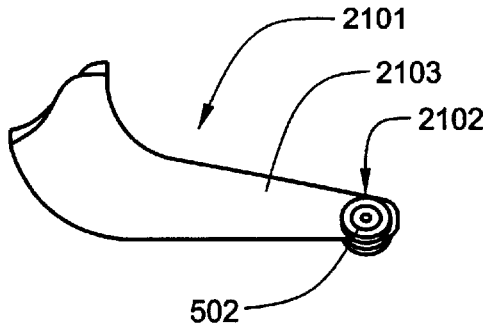
FIG. 21 shows an alternative embodiment for a roller-equipped foot, the roller having a shielded upper portion.

Referring now to FIG. 21, an alternative embodiment for a roller equipped foot 2101 is shown. As the arm retracts away from the stack, the roller is turning against any sheets that are resting thereupon. To prevent the rotating roller from disturbing the sheets of the newly accumulated stack 602, the upper portion 2102 of the roller 502 is shielded. This is accomplished most simply by designing the foot body 2103 so that it has greater height than the uppermost portion of the roller 502.

Although only a single embodiment of the invention has been heretofore described, it will be obvious to those having ordinary skill in the art that changes and modifications may be made thereto without departing from the scope and the spirit of the invention as hereinafter claimed.

What is claimed is:

1. In combination with a paper handling device having a frame and an output tray movable between uppermost and lowermost positions on said frame, an apparatus for holding an existing stack of paper at opposite sides thereof so that a new job may be deposited over the existing stack without degrading the stacking quality of the existing stack, said apparatus including first and second mirror-image paper hold mechanisms, each mechanism having sufficient weight to secure a single edge of the existing stack, each mechanism comprising:

a cylindrical guide pin anchored to said frame;

a cam anchored to said frame, said cam having a grooved path that lies in one or more planes that are perpendicular to the cylindrical axis of said guide pin, said path having vertical upward component, a downward component with a vertical upper portion and a lower portion that arcs away from the center of said stack, and a return component which connects the lowermost points of the downward and upward components;

an arm having a longitudinally-oriented slot in a laminar upper portion thereof, said slot sized to slidably engage said guide pin, said arm also having upper and lower ends, movement of said arm about said pin substantially limited to a plane perpendicular to the cylindrical axis of said guide pin;

a foot affixed to the lower end of said arm, said foot sized and adapted to engage an upper edge of said stack; and a cam follower affixed to a central portion of said arm, said cam follower engaging the path of said cam.

2. The apparatus of claim 1, wherein:

as said output tray rises upwardly against the feet and is brought to a vertical machine reference level, the arm slides upwardly over the guide pin;

as a new output job is deposited on top of the feet, the output tray is lowered in order to maintain the reference level even with the top of a new accumulating stack consisting printed sheets of the new output job;

as the tray approaches its lowermost position of travel, the arms swing outwardly, thereby disengaging the feet from both the existing stack and the newly accumulated stack; and before the tray begins to rise again to said reference level, each of the arms resets itself so that when the tray rises to engage the arms, the feet hold opposite upper edges of a combined stack consisting of the existing stack and the newly accumulated stack.

3. The apparatus of claim 1, wherein each foot is equipped with a stack contacting roller.

4. The apparatus of claim 1, wherein the said cam comprises first and second spaced-apart, opposed faces, said first face having a first portion of said path, said second face having a second remaining portion of said path, and said cam follower riding between said first and second faces.

5. The apparatus of claim 4, wherein:

said cam follower has a follower pin that is perpendicular to both faces, said follower pin being slidable within a collar that is rigidly affixed to said arm so as to alternately engage the path portions of said first and second faces; and each of said path portions includes a ramp which slidably shifts said follower pin to the path portion on the opposing face.

6. The apparatus of claim 5, wherein said follower pin includes a pair of circumferential detent grooves which are spaced apart a distance equal to the distance the follower pin must slide from engagement with the path portion one face to engagement of the path portion of the opposing face.

7. The apparatus of claim 1, wherein said cam comprises a continuous single path formed on a single face, said cam follower includes a spring-loaded follower pin perpendicular to said single face which follows said single path, and a lower portion of said vertical upward path component includes a ramp, the raised portion of said ramp acting as a deflector which directs the cam follower from said downward vertical upper portion to said downward arcuate lower portion, said follower pin abruptly dropping from said raised portion to a lower-level upper portion of said vertical upward path when the output tray is raised to its reference level from its lowermost position.

8. The apparatus of claim 7, wherein said cam follower comprises:

a stalk rigidly affixed to a central portion of said arm;

a pin carrier rigidly affixed to said stalk, said pin carrier having a cylindrical cavity;

a follower pin trapped within said pin carrier, said follower pin having a cylindrical end which extends outside the pin carrier and rides on the single continuous path; and a spring also trapped within said pin carrier which biases said follower pin against said single continuous path.

9. The apparatus of claim 1, wherein said cam follower is rigidly affixed to said arm via a stalk, and said cam comprises a guide slot which maintains the cam follower at a relatively constant distance from the plane or planes in which said path lies.

10. The apparatus of claim 1, wherein each mechanism includes a weight rigidly affixed to a lower portion of said arm that more than counterbalances the foot associated with that mechanism.

11. In combination with a paper handling device having a frame and an output tray movable between uppermost and lowermost positions on said frame, an apparatus for holding an existing stack of paper at opposite sides thereof so that a new job may be deposited over the existing stack without degrading the stacking quality of the existing stack, said apparatus including first and second opposed paper hold mechanisms, each mechanism having sufficient weight to secure a single edge of the existing stack, each mechanism comprising:

a cylindrical guide pin anchored to said frame;

an arm having a longitudinally-oriented slot in a laminar upper portion thereof, said slot sized to slidably engage said guide pin, said arm also having upper and lower ends, movement of said arm about said pin substantially limited to a plane perpendicular to the cylindrical axis of said guide pin;

a foot affixed to the lower end of said arm, said foot sized and adapted to engage an upper edge of said stack;

a cam follower affixed to a central portion of said arm, said cam follower engaging the path of said cam; and a cam anchored to said frame, said cam having a path that engages said cam follower, said cam and cam follower acting in concert such that as said output tray loaded with an existing stack rises upwardly against said foot and is brought to a vertical machine reference level, the foot rests motionless with respect to the stack on an upper edge of said stack as said arm slides upwardly over the guide pin; as a new output job is deposited on top of the feet, and the output tray is lowered in order to maintain the reference level even with the top of a new accumulating stack consisting printed sheets of the new output job, the foot rests on said upper edge for at least a portion of the downward movement of said output tray; as the tray approaches its lowermost position of travel, the arms swings outwardly, thereby disengaging the foot from between said upper edge and the newly accumulated stack; and before said output tray begins to rise again to said reference level, said arm resets itself so that when the tray rises to engage the arms, the foot once again rests motionless with respect to the stack.

12. The apparatus of claim 11, wherein each foot is equipped with a stack contacting roller.

13. The apparatus of claim 12, wherein an upper surface of said roller is shielded.

14. The apparatus of claim 11, wherein the said cam comprises first and second spaced-apart, opposed faces, said first face having a first portion of said path, said second face having a second remaining portion of said path, and said cam follower riding between said first and second faces.

15. The apparatus of claim 14, wherein:

said cam follower has a follower pin that is perpendicular to both faces, said follower pin being slidable within a collar that is rigidly affixed to said arm so as to alternately engage the path portions of said first and second faces; and each of said path portions includes a ramp which slidably shifts said follower pin to the path portion on the opposing face.

16. The apparatus of claim 15, wherein said follower pin includes a pair of circumferential detent grooves which are spaced apart a distance equal to the distance the follower pin must slide from engagement with the path portion one face to engagement of the path portion of the opposing face.

17. The apparatus of claim 11, wherein said cam comprises a continuous single path formed on a single face, said cam follower includes a spring-loaded follower pin perpendicular to said single face which follows said single path, and a lower portion of said vertical upward path component includes a ramp, the raised portion of said ramp acting as a deflector which directs the cam follower from said downward vertical upper portion to said downward arcuate lower portion, said follower pin abruptly dropping from said raised portion to a lower-level upper portion of said vertical upward path when the output tray is raised to its reference level from its lowermost position.

18. The apparatus of claim 17, wherein said cam follower comprises:

a stalk rigidly affixed to a central portion of said arm;

a pin carrier rigidly affixed to said stalk, said pin carrier having a cylindrical cavity;

a follower pin trapped within said pin carrier, said follower pin having a cylindrical end which extends outside the pin carrier and rides on the single continuous path; and a spring also trapped within said pin carrier which biases said follower pin against said single continuous path.

19. The apparatus of claim 11, wherein said cam follower is rigidly affixed to said arm via a stalk, and said cam comprises a guide slot which maintains the cam follower at a relatively constant distance from the plane or planes in which said path lies.

20. The apparatus of claim 11, wherein each mechanism includes a weight rigidly affixed to a lower portion of said arm that more than counterbalances the foot associated with that mechanism.

* * * * *

UNITED STATES PATENT AND TRADEMARK OFFICE

CERTIFICATE OF CORRECTION

PATENT NO. : 6,702,278 B1
DATED : March 9, 2004
INVENTOR(S) : Teodoro Oritiz Michel It is certified that error appears in the above-identified patent and that said Letters Patent is hereby corrected as shown below:

Column 1,
Line 45, delete “transnational” and insert therefor -- translational --

Column 2,
Line 12, delete “and. The” and insert therefor -- and the --
Line 17, after “includes” delete “incorporates”
Line 52, delete “curing” and insert therefor -- curving --

Column 3,
Line 6, after “elevational” insert -- view --

Column 5,
Line 7, after “movement” insert -- is --
Line 46, after “arm 503” insert -- has --
Line 54, delete “it” and insert therefor -- its --

Signed and Sealed this

Eighth Day of February, 2005

JON W. DUDAS
*Director of the United States Patent and Trademark Office*